United States Patent [19]

Merten et al.

[11] 4,119,347

[45] Oct. 10, 1978

[54] COAL PLOUGH HAVING SEPARATELY ADJUSTABLE CUTTERS AND FLEXIBLE FLUID POWER AND CONTROL LINES THEREFOR

[75] Inventors: Gerhard Merten, Lunen; Horst Schlüsener, Werne, both of Fed. Rep. of Germany

[73] Assignee: Gewerkschaft Eisenhutte Westfalia, Lunen, Fed. Rep. of Germany

[21] Appl. No.: 770,496

[22] Filed: Feb. 22, 1977

[30] Foreign Application Priority Data

Feb. 21, 1976 [DE] Fed. Rep. of Germany ..... 2607100

[51] Int. Cl.[2] ..... E21C 27/32

[52] U.S. Cl. ..... 299/34; 299/80; 299/81

[58] Field of Search ..... 299/30, 32, 34, 62, 299/80, 86, 81; 175/0.6; 138/111

[56] References Cited

U.S. PATENT DOCUMENTS

| | | | |
|---|---|---|---|
| 1,503,870 | 8/1924 | Ball et al. | 299/81 X |
| 3,361,479 | 1/1968 | Lobbe | 299/34 |
| 3,866,670 | 2/1975 | Cramer et al. | 138/111 X |

*Primary Examiner*—Ernest R. Purser

*Attorney, Agent, or Firm*—Sughrue, Rothwell, Mion, Zinn and Macpeak

[57] ABSTRACT

A coal plough has a main body guided for movement back and forth along a longwall coal face. The body supports various cutting tool carriers which are adjustable with the aid of hydraulic piston and cylinder units. Fluid is supplied to these units by means of a flexible composite line which also conveys control signals remotely initiated for selecting the units to be charged with fluid to effect the adjustment desired.

2 Claims, 3 Drawing Figures

C
10
11
12
13
14
15
16
17'
20'
24'
26'
31
32
33
34
35
36

37
38
38
39

COAL PLOUGH HAVING SEPARATELY ADJUSTABLE CUTTERS AND FLEXIBLE FLUID POWER AND CONTROL LINES THEREFOR

BACKGROUND TO THE INVENTION

The present invention relates to a mineral winning machine and particularly, but not solely, to coal ploughs.

It is known to construct a coal plough with adjustable tool carriers or holders and various designs have been employed in the art.

The adjustment of the carriers may involve a pivoting action effected by the engagement of the coal face or effected by adjusting devices mounted on the plough structure itself. It is also known to supply water to spray nozzles on a coal plough to suppress dust. For this purpose a trailing hose accommodated in a trough carrier by a longwall conveyor can be used to supply the water. It has been proposed to utilize this water supply to effect adjustment or other operations of the plough — see for example, German patent specification No. 2254774. However, the use of low pressure of the water supply for the nozzles necessitates unduly large control components. To overcome this problem it has also been proposed to provide the plough with a high-pressure pump and drive motor but the resulting construction is subject to corrosion problems and any fluctuation in the low pressure water supply can adversely affect the operation of the plough.

A general object of the present invention is to provide an improved form of plough.

SUMMARY OF THE INVENTION

In accordance with the invention a mineral winning machine or coal plough of the type adapted to be moved back and forth along a mineral or coal face has a body with adjustable cutting tool carriers, means supported by the body for effecting adjustment of said carriers and a composite flexible line for providing both motive power for the adjusting means and remotely-initiated control signals for controlling the selective operation of the adjusting means.

The adjusting means may comprise hydraulically operated devices, such as piston and cylinder units, supplied with a high pressure motive fluid via a pressure conduit or duct of the flexible line. Control valves responsive to the control signals, which may be of hydraulic, pneumatic or electric nature, can be provided on the body to connect desired devices or units to the motive pressure fluid. To reduce the number of control valves required it is useful to have a single common valve controlling several devices or units from one control line. Furthermore, valves responsive to different control pressures can be used. Double-acting piston and cylinder units are a preferred form of device for adjusting the tool carriers although units with spring biased pistons can be used.

The flexible line preferably has a plurality of control lines or conduits for the control signals mounted in an assembly with the high pressure conduit and enclosed in a protective outer sheath. In known manner, the flexible line can be trailed by the machine and looped in a protective trough.

In one constructional embodiment of the invention, described hereinafter, a low pressure oil or oil/water emulsion is used to provide the control signals while a high pressure oil or oil/water emulsion provides the motive power.

The machine or plough can be propelled by an endless chain or by drive means supported by its body. In this latter case the drive means can also be supplied with motive power from flexible line. Water-spraying nozzles supplied with water via the flexible line can also be mounted to the body.

In a coal plough made in accordance with the invention all the setting operations can be initiated by remote generation of control signals. Thus, for example, the floor cutters can be set to control the cutting path of the plough, various tool carriers can be pivoted to bring their cutters into operative or non-operative positions and roof cutters can be raised or lowered.

The invention may be understood more readily and various other features of the invention may become apparent from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figures 1, 3:
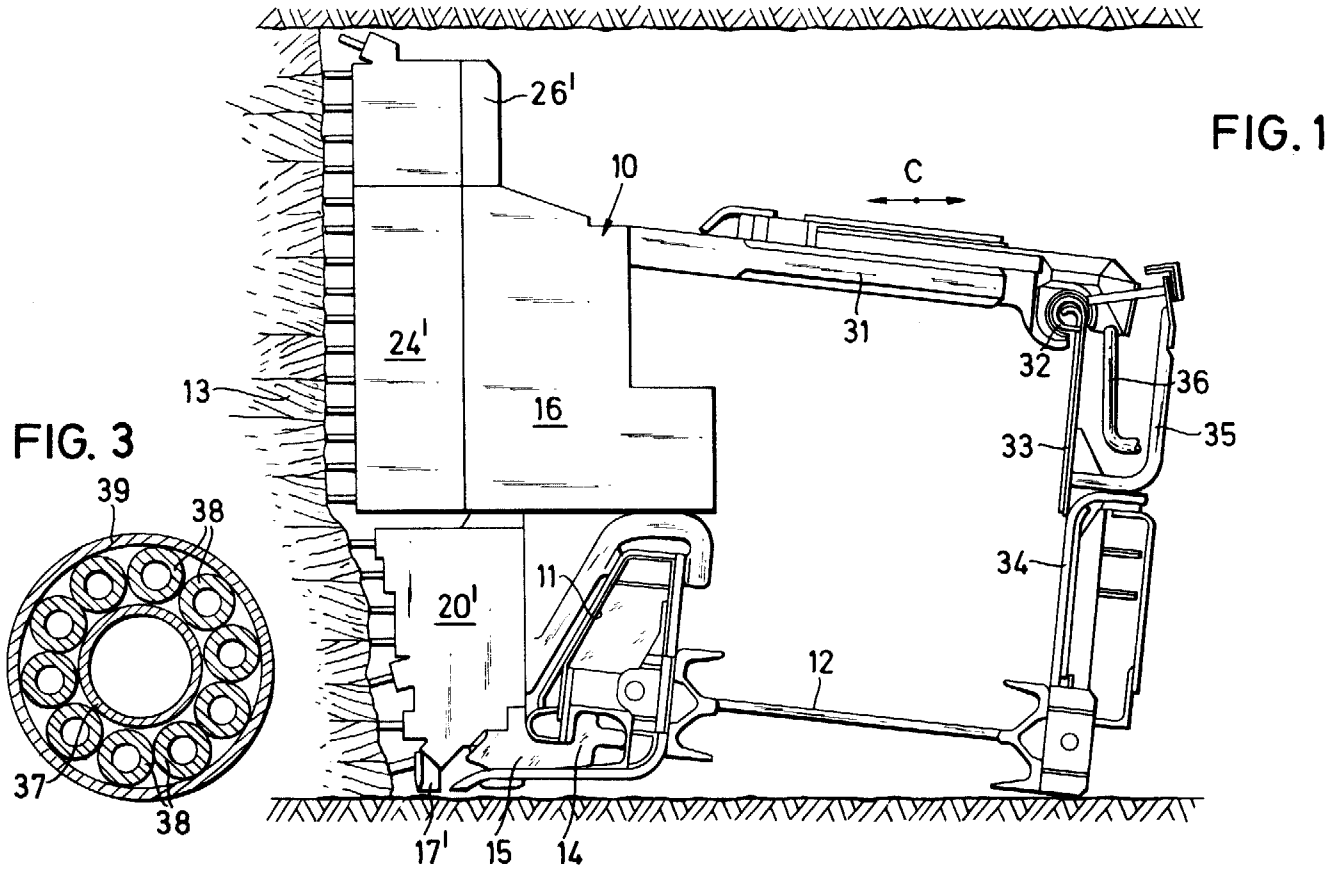
FIG. 1 is a diagrammatic end view of a mine installation employing a mineral winning machine made in accordance with the invention.
FIG. 3 is a cross-sectional view of the composite hose line for the machine.
Figure 2:
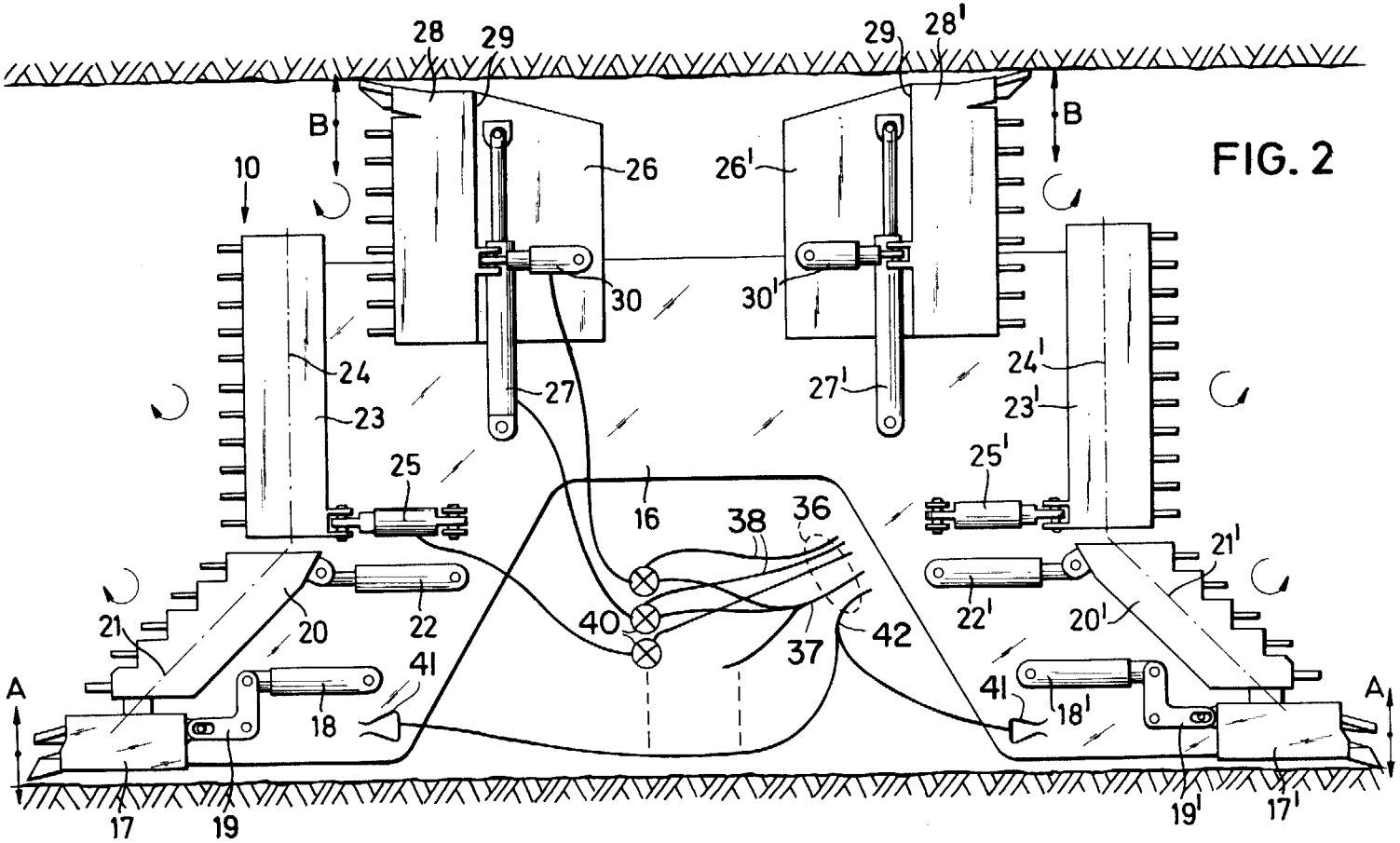
FIG. 2 is a diagrammatic elevation of the machine as seen from the mineral face.

As shown in FIGS. 1 and 2, a mineral winning machine in the form of a coal plough 10 is guided in known manner by guide means 11 located at the coal-face side of a longwall scraper-chain conveyor 12. In known manner, the plough 10 is moved back and forth along the guide means 11 to strip coal from the coal face 13. An endless chain running in guide channels located inside shaped ramp plates of the guide means 11 serves to slidably move the plough along the guide means 11. The plough 10 itself has guides 14 extending into the lower guide channel and drivably coupled with the drive chain and these guides 14 connect with skids 15 slidably supported by extended foot plates of the guide means 11.

The plough 10 has a main body 16 of arch or portal configuration with end portions engaging on the skids 15. The body 16 is provided with various sets of cutting tools or cutters supported by mounting pieces or carriers.

As shown in FIG. 2, the end portions of the plough body 16 are equipped with floor cutters supported by carriers 17, 17'. The carriers 17, 17' are adjustable in the directions of arrows A to control the cutting position of the plough. The adjustment of the carriers 17, 17' is effected by double-acting hydraulic piston and cylinder units 18, 18'. The units 18, 18' have their cylinders supported by the end portions of the plough body 16 and their piston rods coupled to the carriers 17, 17' via cranked elbow levers 19, 19'.

Above the carriers 17, 17' there are carriers 20, 20' provided with vertically staggered cutters in echelon configuration. The carriers 20, 20' are adjustable about inclined axes 21, 21'. The adjustment of the carriers 20, 20' is effected by double-acting hydraulic piston and cylinder units 22, 22'. The units 22, 22' have their cylinders supported by the end portions of the plough body 16 and their piston rods coupled to the upper parts of the carriers 20, 20'.

Further carriers 23, 23' are located at the ends of the plough above the carriers 20, 20'. These carriers 23, 23' support sets of vertically arranged cutters and the carriers 23, 23' are adjustable about vertical axes 24, 24'. The adjustment of the carriers 23, 23' is effected by double-acting hydraulic piston and cylinder units 25, 25'. The units 25, 25' have their cylinders supported by the end portions of the plough body 16 and their piston rods coupled to the lower parts of the carriers 23, 23'.

At the central arch portion of the plough body 16 there are carriers 26, 26' provided with vertically arranged cutters. The carriers 26, 26' are adjustable in the directions of arrows B. This adjustment is effected by double-acting hydraulic piston and cylinder units 27, 27' arranged in vertical orientation. The cutters pertaining to the carriers 26, 26' are supported by holders 28, 28' pivotable about axes 29, 29' in relation to the carriers 26, 26'. The holders 28, 28' are adjustable about the axes 29, 29' with double-acting hydraulic piston and cylinder units 30, 30' coupled between the carriers 26, 26' and their respective holders 28, 28'.

As shown in FIG. 1, the plough body 16 is connected to an arm or jib 31 extending over the conveyor 12 and slidably engaging on a guide rail 32 supported in an elevated position by structures 33, 34 attached to the conveyor goaf side wall. The jib 31 is telescopic and can be extended or retracted in length (arrows C) with the aid of a double-acting hydraulic piston and cylinder unit (not shown) conveniently mounted therein. The adjustment of the length of the jib 31 regulates the angular position of the plough body 16. A trough or channel 35 mounted to the structure 33 accommodates a flexible looped supply line 36. In known manner the line 36 is lifted from the trough 35 in a progressive manner as the plough 10 proceeds along the guide means 11 in one direction and is then laid back in the trough 35 in a loop as the plough 10 proceeds back in the reverse direction. The line 36 is guided by the jib 31 to the plough body 16 for operative connection with the units 18, 18', 22, 22', 25, 25', 27, 27' and 30, 30' and the unit for operating the jib 31, and with associated control valves (not shown).

The line 36 is connected to pressure fluid supply means preferably located centrally of the longwall working.

As shown in FIG. 3, the line 36 is of composite form with a flexible central duct or conduit 37 around which is arranged a plurality of further conduits 38. The conduits 38, 37 are all covered with a flexible outer sheath 39 which may be formed from strip material wound around the assembly, 38, 37 in helical manner. The central conduit 37 is fed with high pressure fluid, preferably an oil/water emulsion whereas the conduits 38 are fed with a lower pressure fluid again preferably an oil/water emulsion. The fluid supply means is preferably constructionally united with control means which selectively feeds low pressure fluid to one or more of the conduits 38. These conduits 38 connect with control valves 40 which open or close connection between the respective working chambers of the various piston and cylinder units mentioned above and the high pressure fluid, as schematically shown in FIG. 2. In this way the adjustment to the plough can be initated and controlled remotely. A return line or path for the pressure fluid can be provided and a return line leading to a reservoir can be incorporated in the composite line 36 or separate therefrom.

A single common control valve can serve to control a pair of corresponding hydraulic units. Thus, for example, the units 18, 18' can have their working chamber connected to a control valve which has its supply switching state changed by a low pressure signal acting on a control or servo piston. In one state the valve connects the working chambers to the high pressure fluid supply to extend one unit 18 and retract the other 18' while conversely in the other state the unit 18 is retracted and the unit 18' extended. The arrangement can be such that the carriers and cutters at the front of the plough 10 relative to its direction of movement are all brought into an operative position whereas the corresponding carriers and cutters at the rear are all retracted and held in a withdrawn inoperative position.

It is also possible to extend the control system by making certain control valves operate at different pressures and by using one control conduit 38 to supply different pressure signals to thereby actuate selected valves.

The plough can also be provided with a set of nozzles 41 for dust suppression. Water can be conveyed to these nozzles by way of an additional conduit 42 in the line 36, as schematically shown in FIG. 2. One or more control valves activated by a further control conduit or conduits 38 can be used to initiate and halt the spraying action. The arrangement can also be modified so that water under pressure is also used to activate the control valves either directly or by means of a pump unit mounted on the plough and supplying fluid or water to the control valves.

The use of pressure fluid for initiating the various adjustments and operations of the plough is not essential and the conduits 38 can convey pneumatic signals to the valves or else the conduits 38 can be replaced by electric cables providing electric signals to the valves.

In a further modification the plough can be self-propelled by its own drive means instead of by the more conventional endless chain. It is preferable here to adopt an arrangement where the plough drive means is mounted to the plough body and drives a toothed wheel which engages with a toothed rack or an apertured rail mounted on or alongside the conveyor. The drive means can be powered with fluid from the conduit 37 or by an additional power line assembled in the hose line 36 and the operation of the drive means can be controlled with signals conveyed along the line 36.

We claim:

1. A coal plough adapted to be moved back and forth along a coal face to win coal therefrom; said plough comprising, in combination:

(a) a body member mounting a plurality of adjustable cutting tool carriers thereon;

(b) a plurality of hydraulically-operated double-acting piston and cylinder units for adjusting said cutting tool carriers;

(c) a composite flexible hose including:

(i) a pressure conduit for conveying pressurized fluid to drive selected piston and cylinder units;

(ii) control lines for conveying remotely-initiated control signals, and (iii) a water supply conduit;

(d) a plurality of control valves responsive to said control signals for connecting selected working chambers of the units to said pressure conduit to operate selected ones of said units, and (e) a plurality of water-spray nozzles for spraying water supplied by the water conduit at the coal face when the plough is operating.

2. A coal plough according to claim 1, wherein the plough is also driven by means of said pressurized fluid.

* * * * *